US007296790B2

(12) United States Patent
Kim

(10) Patent No.: US 7,296,790 B2
(45) Date of Patent: Nov. 20, 2007

(54) AUTOMATIC DOCUMENT FEEDING APPARATUS

(75) Inventor: Won-Taek Kim, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 376 days.

(21) Appl. No.: 10/935,166

(22) Filed: Sep. 8, 2004

(65) Prior Publication Data

US 2005/0104273 A1 May 19, 2005

(30) Foreign Application Priority Data

Nov. 18, 2003 (KR) ..... 10-2003-0081735

(51) Int. Cl.
*B65H 3/06* (2006.01)

(52) U.S. Cl. ..... 271/114; 271/118

(58) Field of Classification Search ..... 271/109, 271/114, 116, 121, 256, 258.02, 258.04, 115, 271/117, 118
See application file for complete search history.

(56) References Cited

U.S. PATENT DOCUMENTS 5,497,986 A * 3/1996 Kudo ..... 271/122
5,718,313 A * 2/1998 Sekine ..... 192/24
5,873,441 A * 2/1999 Tsujishita ..... 192/46
6,070,867 A * 6/2000 Tsurumi et al. ..... 271/114
6,390,463 B1 * 5/2002 Iwago ..... 271/118
6,578,840 B1 * 6/2003 Kudo ..... 271/10.13
6,651,971 B2 * 11/2003 Tsuei ..... 271/109
2003/0184000 A1 * 10/2003 Kim ..... 271/10.11
2005/0280206 A1 * 12/2005 Ahn et al. ..... 271/273

FOREIGN PATENT DOCUMENTS

| | | |
|---|---|---|
| JP | 03-227843 | 10/1991 |
| JP | 10-203659 | 8/1998 |
| JP | 11-100136 | 4/1999 |
| JP | 2001-002255 | 1/2001 |
| JP | 2002240970 A * | 8/2002 |

* cited by examiner

*Primary Examiner*—Patrick Mackey
*Assistant Examiner*—Michael C McCullough
(74) *Attorney, Agent, or Firm*—Roylance, Abrams, Berdo & Goodman L.L.P.

(57) ABSTRACT

An automatic document feeding apparatus includes a shaft, an ADF roller for feeding documents piece by piece by cooperating with a separating member, and a power switching member for selectively connecting a driving member with the shaft. The power switching member is installed on the shaft. The ADF roller is also mounted on the shaft such that the ADF roller can rotate by receiving a torque only in a first direction.

6 Claims, 9 Drawing Sheets

AUTOMATIC DOCUMENT FEEDING APPARATUS

BACKGROUND OF THE INVENTION

This application claims the benefit under 35 U.S.C. §119 (a) of Korean Patent Application No. 2003-81735 titled "Automatic Document Feeding Apparatus," filed on Nov. 18, 2003, in the Korean Intellectual Property Office, the entire disclosure of which is incorporated herein by reference.

FIELD OF THE INVENTION

The present invention relates to an automatic document feeding apparatus. More particularly, the present invention relates to an automatic document feeding apparatus having an automatic document feeding (ADF) roller designed to transmit power only in one direction.

DESCRIPTION OF THE RELATED ART

Generally, a document feeding apparatus in a telecopy machine, a copy machine, a scanner, and a digital compound machine is used to feed documents stacked in a feeding base to reading means for reading image information printed or written down on the documents.

FIG. 1 shows a conventional automatic document feeding apparatus. As shown in the drawing, a conventional automatic document feeding apparatus includes a shaft 2 rotated by driving means (not shown) connected to a gear 3, an ADF roller 3 installed on the shaft 2, and separating means 4 for separating documents D sheet by sheet. A feed roller 5 for feeding the documents at a predetermined speed is provided on a front end of the ADF roller 3. The feeding speed of the ADF roller 3 is identical to or less than that of the feed roller 5. In general, the feeding speed of the ADF roller 3 is slightly less than that of the feed roller 5. Therefore, when the feed roller 5 starts feeding the documents D fed to a feeding base 1 by the ADF roller 3, the document D may be torn between the ADF roller 3 and the feed roller 5 due to the difference in the feeding speed therebetween.

To solve this problem, a clutch (not shown) is provided in the automatic document feeding apparatus. That is, when the shaft 2 rotates in a first direction where the document D is fed, the clutch is engaged with the ADF roller 3 and transmits a torque to the ADF roller 3, and when the shaft 2 rotates in a second direction opposite to the first direction, the clutch is disconnected from the ADF roller and the torque from the shaft 2 is not transmitted. When the feed roller 5 starts feeding the document D, the ADF roller 3 rotates faster than the shaft 2. At this point, since the shaft 2 is disconnected from the ADF roller 3 by the clutch, the ADF roller 3 can smoothly rotate in response to the feeding speed of the feed roller 5.

In addition, while the feed roller 5 is feeding the document D, the document D may be jammed. In this case, the jammed document D may be removed by pulling a front end of the document D in a direction A. At this point, the jammed document D is removed as the ADF roller 3 smoothly slips on the shaft 2. Alternatively, in case of pulling a rear end of the jammed document D to remove the jammed document D, the clutch is operated in an opposite direction such that the ADF roller 3 rotates the shaft 2 in the second direction. At this point, since the shaft 2 is connected to the driving means by a plurality of reduction gears, the ADF roller 3 rotates against a relatively large amount of resistance. As a result, it becomes difficult to remove the jammed document D, and, in the worst case, the jammed document D may be torn.

The automatic document feeding apparatus may further include a pickup roller 7 for picking up the document D and feeding the same to the ADF roller 3. The pickup roller 7 contacts the document D only when picking up the document D. That is, when the pickup operation is completed, the pickup roller 7 moves away from the document D. The pickup roller 7 is installed on a bracket 8 rotatably coupled on the shaft 2. In order to rotate the bracket 8, the driving means should be designed to bi-directionally rotate. However, the direction change of the driving means slows down the document feeding speed, thereby reducing the number of documents fed per unit of time.

SUMMARY OF THE INVENTION

Embodiments of the present invention provide an automatic document feeding apparatus that can easily remove a jammed document regardless of a pulling direction of the jammed document.

Also, embodiments of the present invention provide an automatic document feeding apparatus that is designed to prevent the reduction of the document feeding speed, which may be caused by a direction change of the driving means.

According to an aspect of the present invention, there is provided an automatic document feeding apparatus comprising a shaft; an ADF roller which feeds documents sheet by sheet by cooperating with separating means, the ADF roller being mounted on the shaft such that the ADF roller can rotate by receiving a torque only in a first direction from the shaft; and power switching means which selectively connects driving means with the shaft, the power switching means being installed on the shaft.

The automatic document feeding apparatus may further comprise a pickup roller which picks up the documents stacked in a feeding base by receiving the torque only in the first direction from the shaft; a bracket rotatably mounted on the shaft, the pickup roller being installed on the bracket; clutching means which transmits the torque of the shaft to the bracket when the shaft rotates in the first direction and does not transmit the torque of the shaft to the bracket when the shaft rotates in a second direction; and an elastic member which biases the bracket in the second direction.

According to another aspect of the present invention, the clutching means may comprise a clutch spring fitted on a first cylindrical projection formed on the shaft and a second cylindrical projection formed on the bracket by first fitting force to allow the bracket to rotate in the first direction, the clutch spring having a first end inserted in a first insertion groove provided on the bracket; a clutch cover which encloses the clutch spring, the clutch cover being provided with a second groove in which a second end of the clutch spring is inserted and a circumferential projection; and a stopper contacting the circumferential projection so as to prevent the clutch spring from rotating in the second direction.

The bracket may be provided with a plurality of the first insertion grooves for adjusting the first fitting force, and the clutch cover is provided with a plurality of the second insertion grooves for adjusting the first fitting force.

The stopper may be provided on the bracket. The power switching means is designed to disconnect the driving means with the shaft when the document is jammed.

BRIEF DESCRIPTION OF THE DRAWINGS

The above and other features and advantages of the present invention will become more apparent by describing in detail exemplary embodiments thereof with reference to the attached drawings in which.

In the drawings, like reference numbers are used to refer to like features and structures.

DETAILED DESCRIPTION OF THE INVENTION

Figure 1:
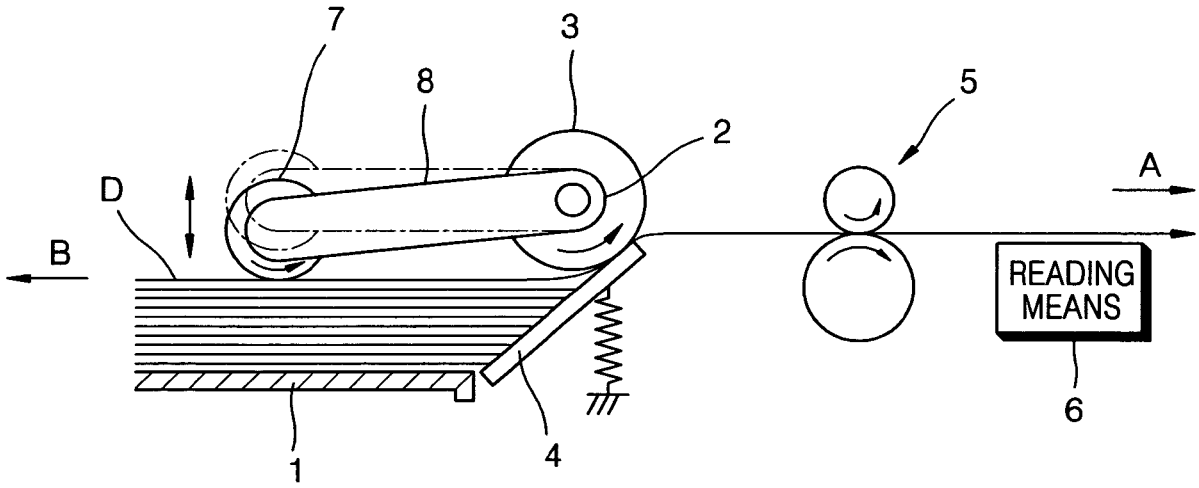
FIG. 1 (PRIOR ART)
FIG. 1 is a schematic view of a conventional automatic document feeding apparatus.

Embodiments of the present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity.

Figure 2:
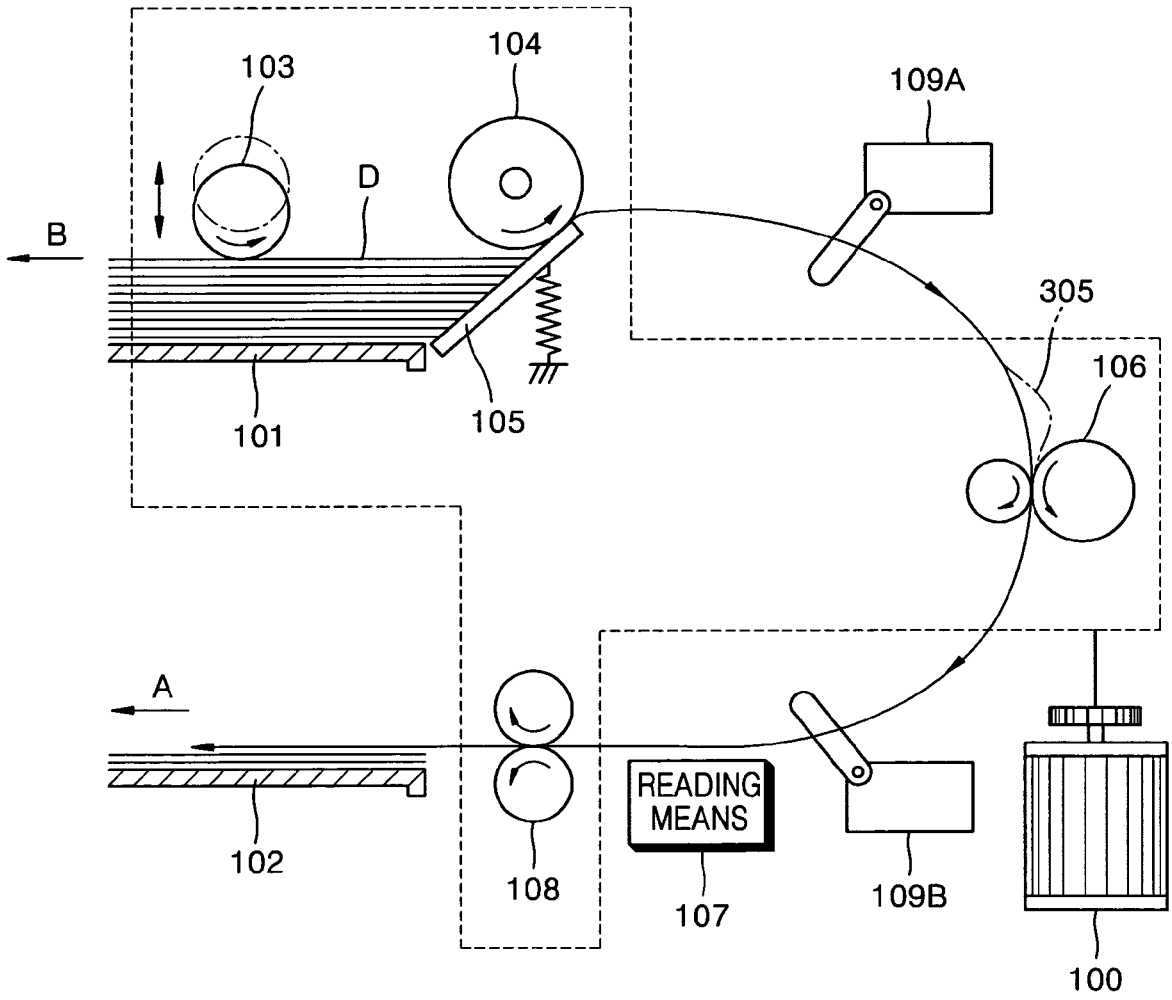
FIG. 2 is a view of an image information input system where an automatic document feeding apparatus according to an embodiment of the present invention is employed.

FIG. 2 shows an image information input system where an automatic document feeding apparatus of the present invention is employed.

As shown in the drawing, there is shown an ADF roller 104 for feeding the documents D stacked in a feeding base 101 to a feed roller 106 sheet by sheet by cooperating with a separating member 105. The separating member 105 is formed of a frictional member biased on the ADF roller 104 by an elastic member. By a friction difference between the ADF roller 104 and the document D, between the documents D, and between the document D and the separating member 105, the documents D can be fed sheet by sheet.

The reference numeral 107 indicates reading means for reading image information printed or written down on the documents D. A contact image sensor (CIS) or a charge coupled device (CCD) may be used as the reading means, among other suitable devices. Reference numerals 109A and 109B respectively indicate first and second detecting sensors for detecting the documents D. That is, the first detecting sensor 109A detects the documents D picked up from the feeding base 101 to determine start timing for aligning a front end of the document D on the feed roller 106. The second detecting sensor 109B detects the front end of the document fed by the feed roller 106 to determine start timing for reading the document by the reading means 107. The second detecting sensor 109B further detects a rear end of the document D to determine if the discharge of the document D is completed. The reference numerals 108 and 102 respectively indicate a discharging roller and a tray for stacking the documents D discharged by the discharging roller 108. For stable document feeding, a pickup roller 103 for picking up the documents stacked in the feeding base 101 and feeding the same between the ADF roller 104 and the separating member 105 may be further provided. In Particular, when the feeding base 101 is horizontally disposed, it is preferable that the pickup roller 103 be provided. Reference numeral 100 indicates driving means for driving the feed roller 106, the ADF roller 104 and the pickup roller 103.

Figure 3:
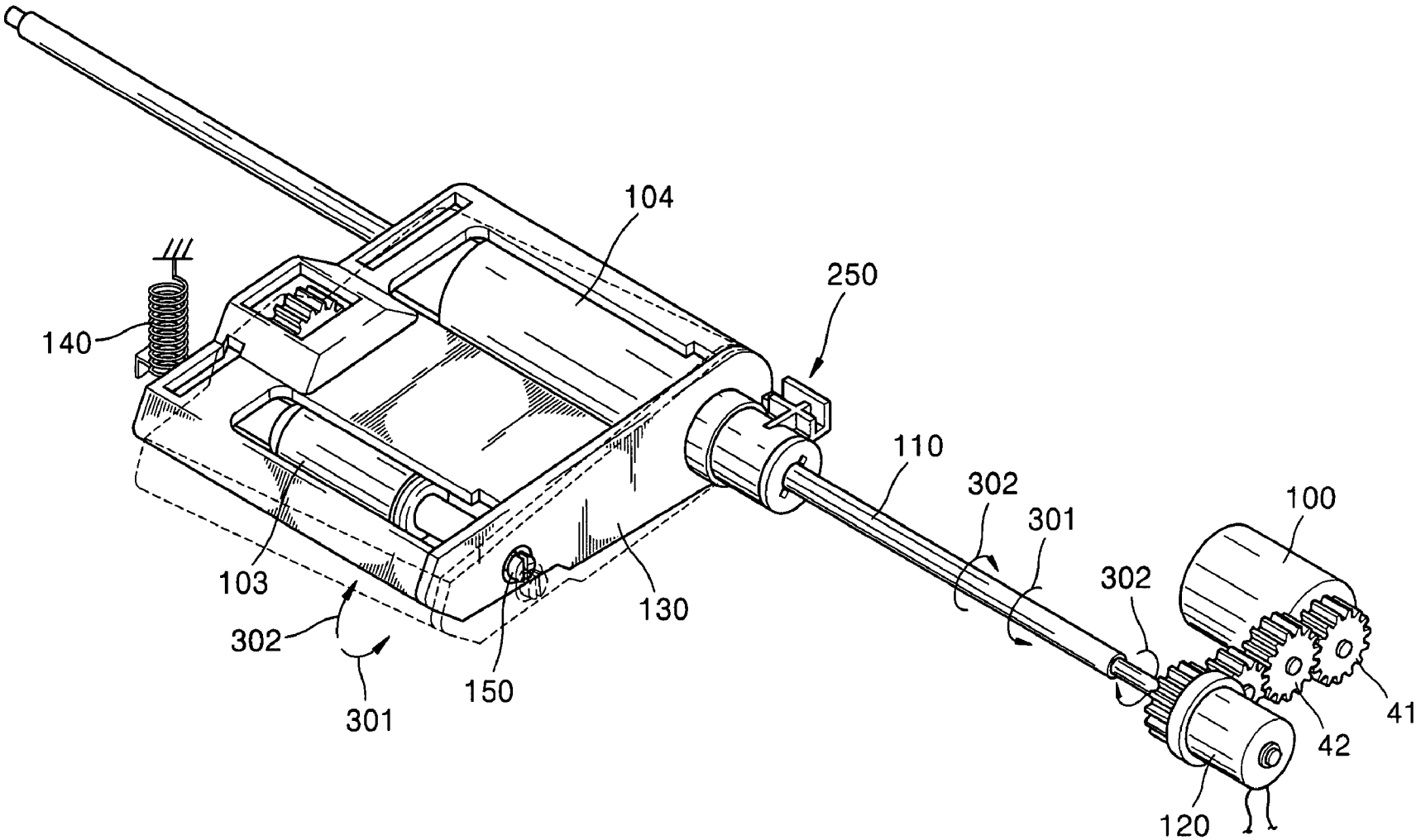
FIG. 3 is a perspective view of an automatic document feeding apparatus according to an embodiment of the present invention.

FIG. 3 shows the automatic document feeding apparatus according to an embodiment of the present invention.

As shown in the drawing, the shaft 110 is rotated by a driving force transmitted from the driving means 100 via a plurality of gears 41 and 42. Power switching means 120 is installed on an end of the shaft 110. A bracket 130 is also installed on the shaft 110. The reference numeral 140 indicates an elastic member for biasing the bracket 130 in a second direction 302.

The power switching means 120 is designed to selectively interconnect the driving means 100 and the shaft 110. An electronic clutch is preferable as the power switching means.

Figure 4:
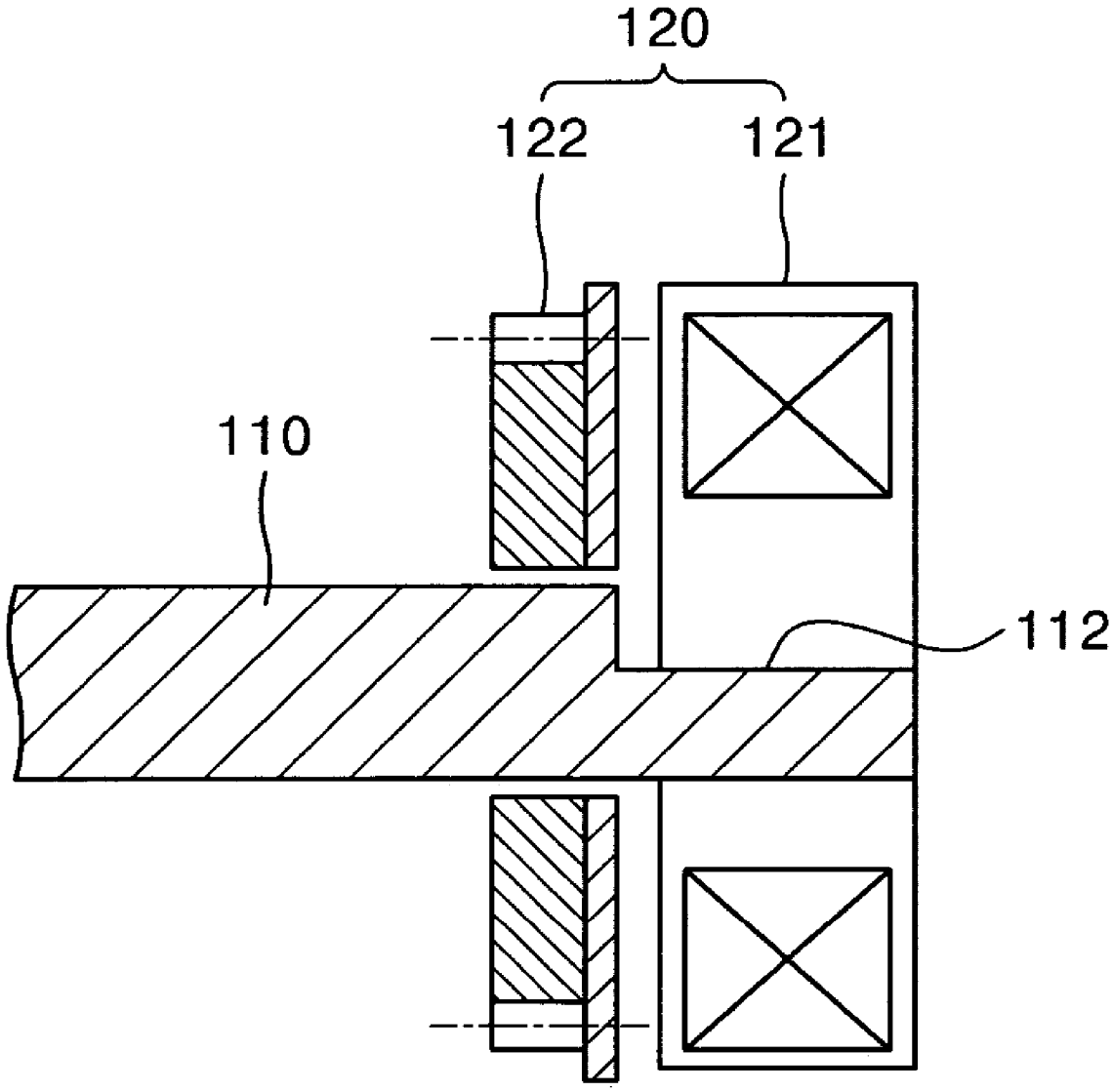
FIG. 4 is a sectional view illustrating a relationship between a shaft and an electronic clutch used as power switching means according to an embodiment of the present invention.

FIG. 4 shows a relationship between the shaft 110 and the electronic clutch used as the power switching means 120 according to an embodiment of the present invention.

As shown in the drawing, the electronic clutch includes an electromagnet 121 and a gear part 122 slightly spaced away from the electromagnet 121 and rotatably installed on the shaft 110. The gear part 122 is connected to the driving means 100 via the gears 41 and 42 (see FIG. 3). When a current is applied to the electromagnet 121, the gear part 122 is attached on the electromagnet 121 by electromagnetic force. Therefore, when the driving means rotates, the electromagnet 121 rotates together with the gear part 122. As shown in FIG. 4, since the electromagnet 121 is installed on a cut-away portion 112 of the shaft 110, the shaft 110 can rotate together with the electron magnet 121. When the current being applied to the electron magnet 121 is cut off, the gear part 122 moves away from the electromagnet 121. In this state, when the driving means rotates, only the gear part 122 rotates while the electromagnet 121 and the shaft 110 do not rotate.

The ADF roller 104 is rotatably installed on the shaft 110. A second shaft 150 is fixedly or rotatably installed on the bracket 130. The pickup roller 103 is rotatably installed on the second shaft 150. The ADF roller 104 and the pickup roller 103 are designed to be subject to rotational force from the shaft 110 only in a first direction 301 (a document feeding direction). That is, the ADF roller 104 and the pickup roller 103 rotate in the first direction 301 only when the shaft 110 rotates in the first direction 301. When the shaft 110 rotates in the second direction 302, the ADF roller 104 and the pickup roller 103 do not rotate.

Figure 5:
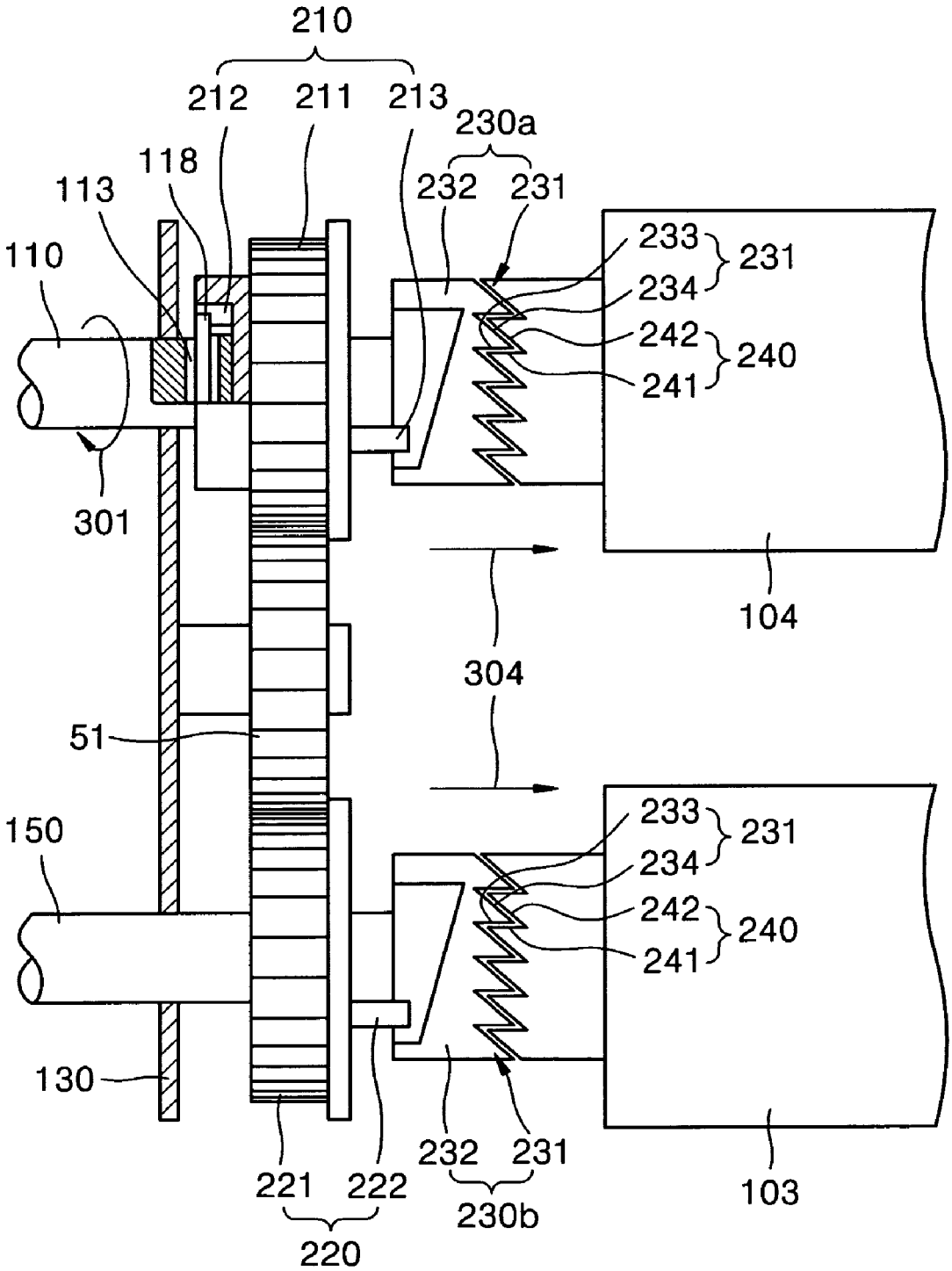
FIGS. 5 and 6 are views illustrating a relationship between a shaft, a pickup roller and an ADF roller according to an embodiment of the present invention.

Referring to FIG. 5, an exemplary structure is shown in which the ADF roller 104 and the pickup roller 103 are designed to receive a torque from the shaft 110 only in the first direction 301. A first member 210 is coupled on the shaft 110 to rotate together with the shaft 110. The first member 210 is provided with a gear portion 211, a lever portion 213 and a pin coupling portion 212. The shaft 110 is provided with a pin hole 113 in which a pin 118 having a length greater than a diameter of the shaft 110 is inserted. When the first member 210 is pushed such that the pin 113 can be inserted in the pin coupling portion 213, the first member 210 is coupled to the shaft 110. Alternatively, the first member 210 may be forcedly fitted on the shaft 110. A gear 51 engaged with the gear portion 211 is mounted on the bracket 130. Rotatably coupled to the second shaft 150 are a second member 220 having a gear part 221 engaged with the gear 51 and a lever portion 222. Third members 230*a* and 230*b* are respectively coupled to the shaft 110 and the second shaft 150 to be capable of sliding in an axial direction thereon. Each of the third members 230*a* and 230*b* is provided with a first power coupling portion 231 formed in a saw tooth shape defined by opposing sections 233 and inclined sections 234 and a spiral concave portion 232 in which the lever portion 213 (222) is inserted. Each of the ADF roller 104 and the pickup roller 103 is provided with a second power coupling portion 240 correspondingly engaged with the first power coupling portion 231, the second power coupling portion 240 being formed in a saw tooth shape defined by opposing sections 241 and inclined sections 242.

When the shaft 110 rotates in the first direction 301, the first member 210 coupled on the shaft 110 by the pin 118 rotates in the first direction 301 together with the shaft 110. The third member 230*a* also rotates in the first direction 301 with the lever portion 213 contacting an end portion of the spiral concave portion 232. The rotational force of the shaft 110 is transmitted to the gear portion 221 of the second member 220 via the gear portion 211 and the gear 51. The second member 220 rotates in the first direction 301 and the third member 230*b* also rotates in the first direction 301 with the lever portion 222 contacting an end portion of the spiral concave portion 232. At this point, when the third members 230*a* and 230*b* rotate in the first direction 301, the opposing sections 233 of the first power coupling portion 231 push the opposing sections 241 of the second power coupling portion 240. Accordingly, the ADF roller 104 and the pickup roller 103 rotate in the first direction 301.

Figure 6:
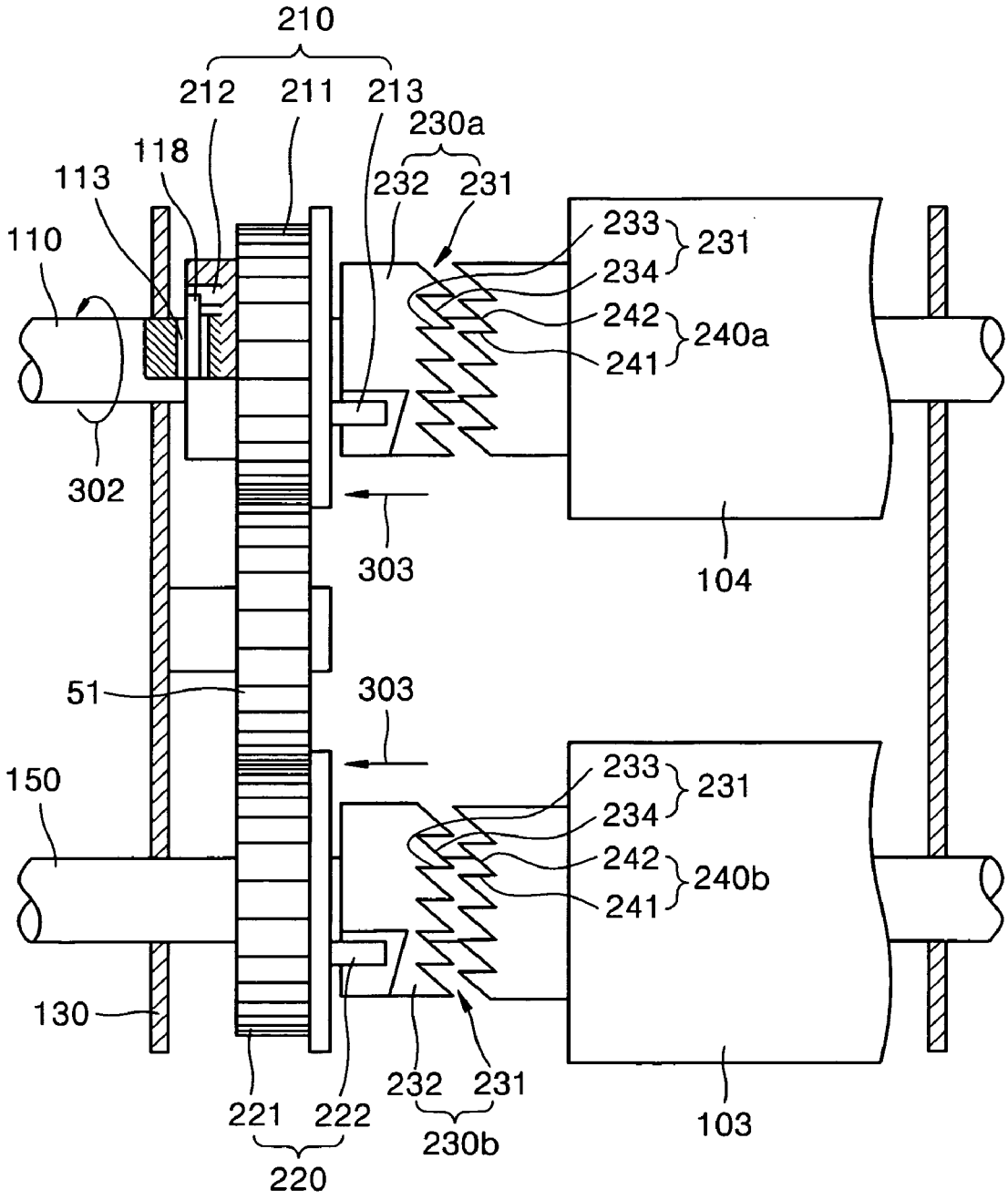

Referring to FIG. 6, when the shaft 110 rotates in the second direction 302, all of the first to third members 210, 220, and 230*a* and 230*b* rotate in the second direction 302, as a result of which the inclined sections 234 of the first power coupling portion 231 push the inclined sections 242 of the second power coupling portions 240*a* and 240*b*. Therefore, the third members 230*a* and 230*b* is pushed in an arrow direction 303 and thereby the first power coupling portion 231 is separated from the second power coupling portion 240. Accordingly, both the ADF roller 104 and the pickup roller 103 do not rotate.

When the shaft 110 rotates in the first direction 301 again, the lever portions 213 and 222 of the first and second members 210 and 220 push the spiral concave portions 232 of the third members 230*a* and 230*b* such that the third members 230*a* and 230*b* slide in the direction of arrow 304 in FIG. 5, thereby the first power coupling portion 231 is coupled to the second power coupling portion 240. Accordingly, as shown in FIG. 5, both the ADF roller 104 and the pickup roller 103 rotate in the first direction 301.

In order to reduce load in the course of feeding the documents D, the pickup roller 103 is preferably designed to contact the documents only when it picks up the documents D. The pickup roller 103 is installed on the bracket 130 rotatably mounted on the shaft 10. Clutching means 250 is disposed between the bracket 130 and the shaft 110 for transmitting rotational force of the shaft 110 to the bracket 130 when the shaft rotates in the first direction and for interrupting rotational force of the shaft 130 when the shaft 110 rotates in the second direction 302 so as not to transmit the rotation force to the bracket 130.

Figure 7:
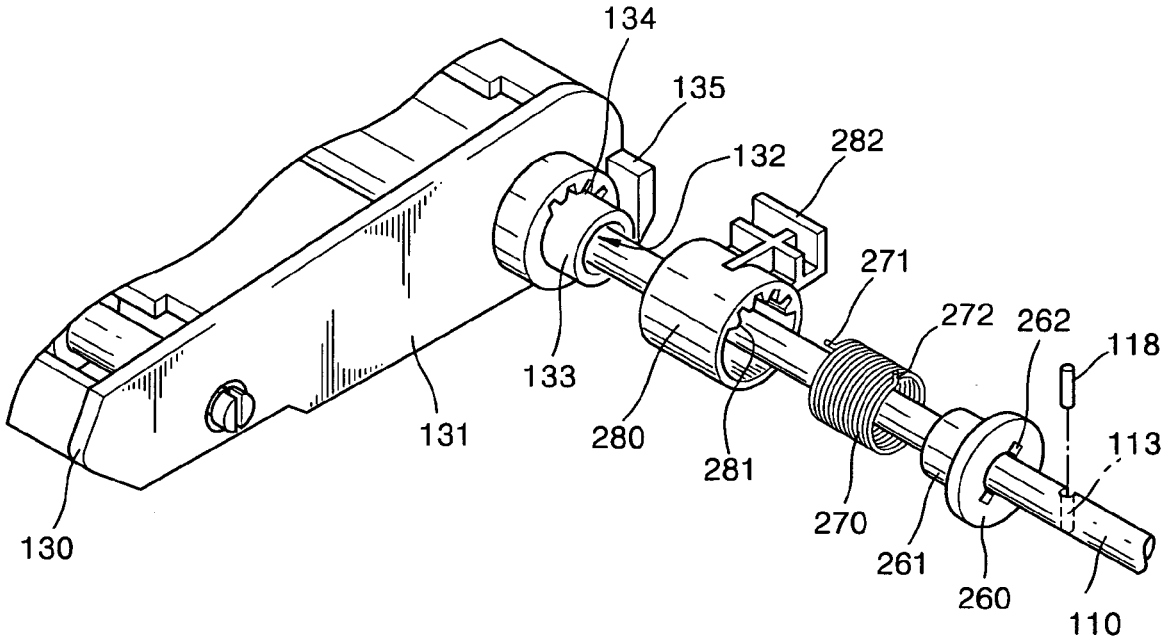
FIG. 7 is an exploded perspective view of clutching means according to an embodiment of the present invention.

FIG. 7 shows the clutching means 250 of FIG. 3 in detail. As shown in the drawing, the bracket 130 is provided at a sidewall 131 with a first cylindrical projection 133 defining an insertion portion 132 in which the shaft 110 is inserted. The bracket 130 is further provided at the sidewall 131 with a first insertion portion 134 in which a first end 271 of a clutch spring 270 is inserted and a stopper 135. The shaft 110 is provided with a pin hole 113. A fourth member 260 provided with a second cylindrical projection 261 and a pin coupling portion 262 are inserted around the shaft 110. The fourth member 260 is coupled on the shaft 110 through a substantially identical manner to the first member 210 of FIGS. 5 and 6. Alternatively, the fourth member 260 may be forcedly fitted around the shaft 110. A clutch cover 280 formed in a hollow shape is disposed enclosing the clutch spring 270. The clutch cover 280 is provided with a second insertion groove 281 in which a second end 272 of the clutch spring 270 is inserted and an outer circumferential projection 282 contacting the stopper 135. The clutch spring 270 is fitted on the first and second cylindrical projections 133 and 261. Since an inner diameter of the clutch spring 270 is less than outer diameters of the first and second cylindrical projections 133 and 261, the clutch spring 270 is inserted around the projections 133 and 261 while being slightly widened. Therefore, the clutch spring 270 biases the first and second cylindrical projections 133 and 261 using a first fitting force.

Figure 8:
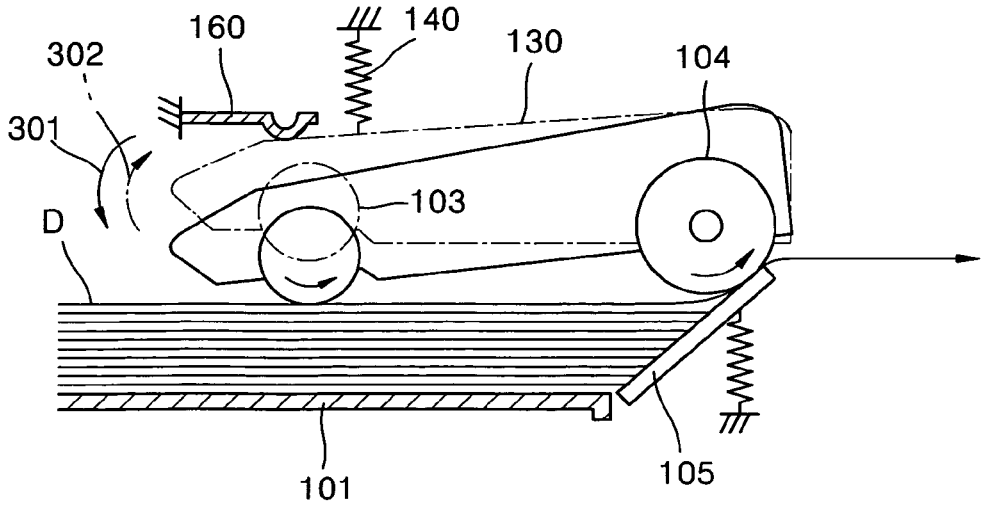
FIGS. 8 and 9 are side views illustrating an operation of clutching means depicted in FIG. 7.

When the shaft 110 rotates in a first direction, the rotational force of the shaft 110 is transmitted to the first cylindrical projection 133 by the first fitting force of the clutch spring 270 via the second cylindrical projection 261. The first end 271 of the clutch spring 270 is inserted in the first insertion groove 134 to push the bracket 130 in the first direction 301 (see FIG. 3). Accordingly, as shown in FIG. 8, the bracket 134 rotates in the first direction 301 and the pickup roller 103 contacts the document D. The pickup roller 103 and the ADF roller 104 rotate in the first direction 301 as described with reference to the FIG. 6.

The first fitting force of the clutch spring 270 should be set such that it can rotate the bracket 130 in the first direction 301 while overcoming an elastic force of the elastic member 140 when the shaft 110 rotates in the first direction 301. To set the first fitting force of the clutch spring in response to this requirement, the bracket 130 and the clutch cover 280 may be provided with a plurality of insertion grooves 134 and 281, respectively. That is, by properly inserting the first and second ends of the clutch spring 270 in the first and second insertion grooves 134 and 281, respectively, the first fitting force can be adjusted.

When the shaft 110 further rotates in the first direction 301 after the pickup roller 103 contacts the document D, the bracket 130 is biased to further rotate in the first direction 301. At this point, the first end 271 of the clutch spring 270 receives repulsive force from the bracket 130 in the second direction 302. At this point, the first fitting force of the clutch spring 270 is reduced as the inner diameter of the clutch spring 270 is widened in a moment. As a result, the clutch spring 270 slips on the first cylindrical projection 133. Accordingly, even when the shaft 110 further rotates in the first direction 301 after the pickup roller 103 contacts the document D, the pickup roller 103 maintains its gentle contacting state without applying excessive pressure to the documents D.

When a predetermined time has elapsed after the front end of the document D is detected by the first detecting sensor 109A, the document D is fed by the feed roller 106. When the document D is fed, since there is no need of rotating the shaft 110, the current being applied to the power switching means 120 is cut off to disconnect the driving means 100 from the shaft 110, thereby stopping the rotation of the shaft 110. The bracket 130 rotates in the second direction 302 by the elastic force of the elastic member 140 to separate the pickup roller 103 from the document D. At this point, the first end 271 of the clutch spring 270 is pushed in the second direction 302 while bracket 130 rotates in the second direction 302. Then, the first fitting force of the clutch spring 270 is reduced as the inner diameter of the clutch spring 270 is widened, and thereby the clutch spring 270 slips on the first cylindrical projection 133. Accordingly, the bracket 130 smoothly rotates in the second direction 302. As shown in FIG. 8, it is preferable that there is provided suppressing means 160 for suppressing the excessive rotation of the bracket 130 in the second direction 302.

When the shaft 110 rotates in the first direction 301 by the driving means 100, the bracket 130 rotates in the first direction 301 to allow the pickup roller 103 to contact the document D. The document D picked up by the pickup roller 103 is fed sheet by sheet while passing through between the ADF roller 104 and the separating means 105. When a front end of the document D is advanced to the feed roller 106, the document D is conveyed by the feed roller 106. Accordingly, there is no need for bi-directionally rotating the driving means 100 and preventing the delay of the feeding time, which is incurred in the conventional automatic document feeding apparatus.

Figure 9:
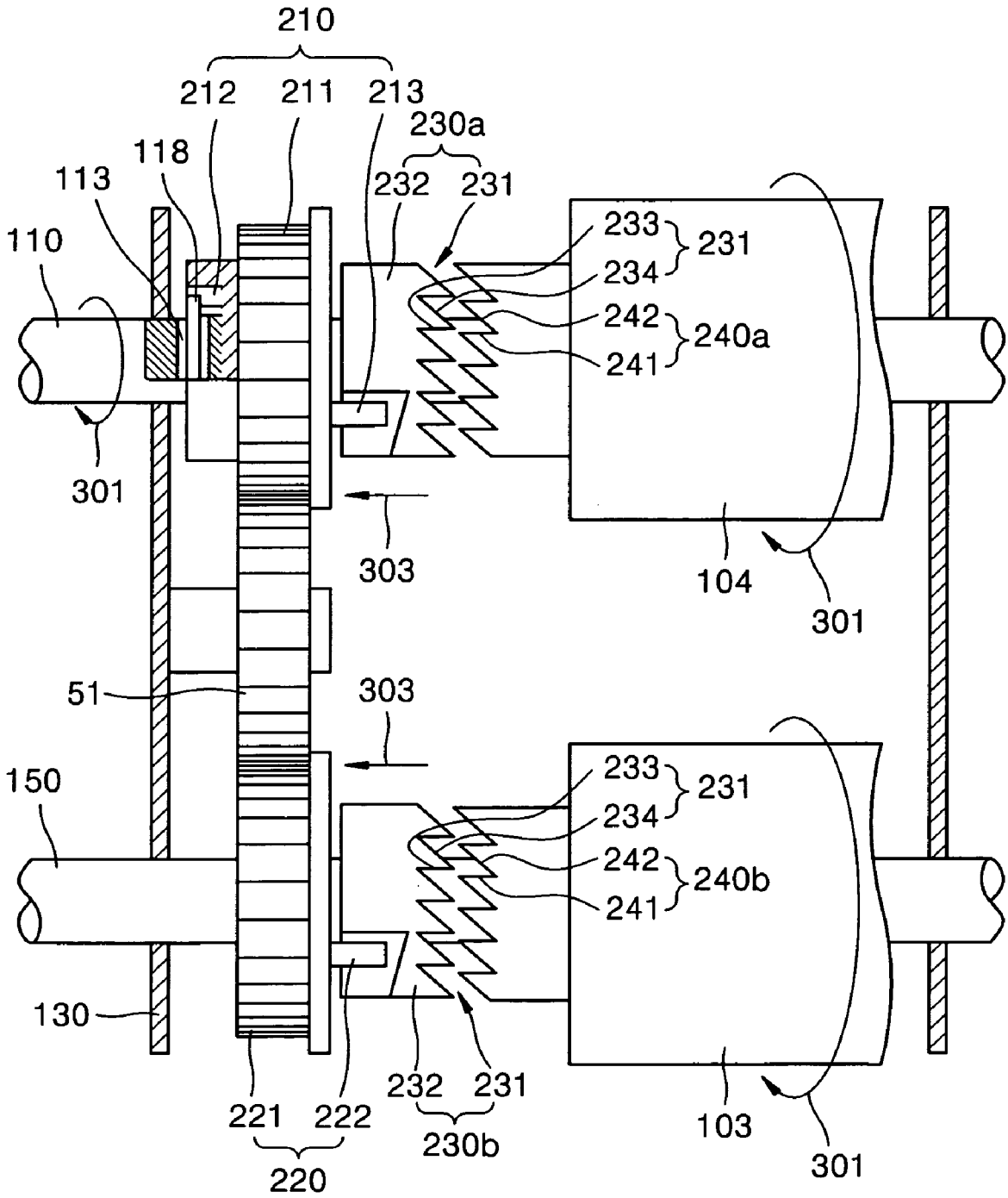

A feeding speed of the ADF roller 104 is identical to or less than that of the feed roller 106. In general, the feeding speed of the ADF roller 104 is slightly less than that of the feed roller 106. Therefore, to prevent the document D from being torn by the difference in the feeding speed, since the ADF roller 104 should rotate in response to the feeding speed of the feed roller 106, the ADF roller 104 should be disconnected with the shaft 110. Referring to FIG. 9, when the ADF roller 104 rotates in the first direction 301 at the feeding speed identical to that of the feed roller 106, the inclined sections 242 of the second power coupling portion 240 push the inclined sections 234 of the first power coupling portion 231 and the third member 230*a* is pushed in the direction of arrow 303. As a result, the power connection between the shaft 110 and the ADF roller 104 is cut off and the ADF roller 104 smoothly rotates in response to the feeding speed of the feed roller 106.

To align the front end of the document D on the feed roller 106, the feed roller 106 does not rotate or rotates in the second direction until the front end of the document D reaches thereto. That is, in a state where the feed roller 106 is stopped or rotates in the second direction 302, the document D is conveyed from the first detecting sensor 109A to slightly over the feed roller 106 after the front end of the document D is detected by the first detecting sensor 109A. As a result, as shown by a broken line 305 of FIG. 2, the document D is neatly curved and aligned on the feed roller 106. In this state, when the feed roller 106 rotates in the first direction 301, the document D is advantageously stably fed without being skewed.

Power switching means that is identical to that shown in FIG. 4 can be further provided on the feed roller 106. In this case, the current applied to the power switching means can be cut off to prevent the feed roller 106 from rotating while the document D is being aligned on the feed roller 106. After the document alignment is finished, the current is applied to the power switching means to convey the document by rotating the feed roller 106.

For the automatic document feeding apparatus that does not employ the aligning process, The ADF roller 104, the pickup roller 103 and the feed roller 106 are continuously rotated only in the first direction 301. At this point, after the front end of the document is inserted in the feed roller 106, the power switching means disconnects the driving means 100 from the shaft 110. As a result, the bracket 130 rotates in the second direction 302 by the elastic force of the elastic member 140 to allow the pickup roller 103 to be separated from the document D and the ADF roller 104 rotates in response to the feeding speed of the feed roller 106.

When the document D is jammed while being conveyed, a jammed location can be identified by checking the first and second detecting sensors 109A and 109B. That is, when the front end of the document D is not detected by the first detecting sensor 109A for a predetermined time after the ADF roller 104 and the pickup roller 103 start rotating, it can be determined that the document D is jammed between the ADF roller 104 and the feed roller 106. When the front end of the document D is not detected by the second detecting sensor 109B for a predetermined time after the front end of the document D is detected by the first detecting sensor 109A, it can be determined that the document D is jammed between the feed roller 106 and the reading means 107. When the rear end of the document D is not detected by the second detecting sensor 109B for a predetermined time after the front end of the document D is detected by the second detecting sensor 109B, it can be determined that the document D is jammed between the reading means 107 and the discharging roller 108.

When it is determined that the document D is jammed between the reading means 107 and the discharging roller 108, since this is the case where the front end of the document D reaches the tray 102, the jammed document D can be removed by pulling the document D in a direction A (FIG. 2). When it is determined that the document D is jammed between the feed roller 106 and the reading means 107, it is impossible to pull the front end of the document D in the direction A. Accordingly, it is possible to remove the jammed document D by pulling the rear end of the document D in a direction B. When the document D is jammed between the ADF roller 104 and the feed roller 106, it is possible to remove the jammed document D by pulling the rear end of the document D in the direction B.

Figure 10:
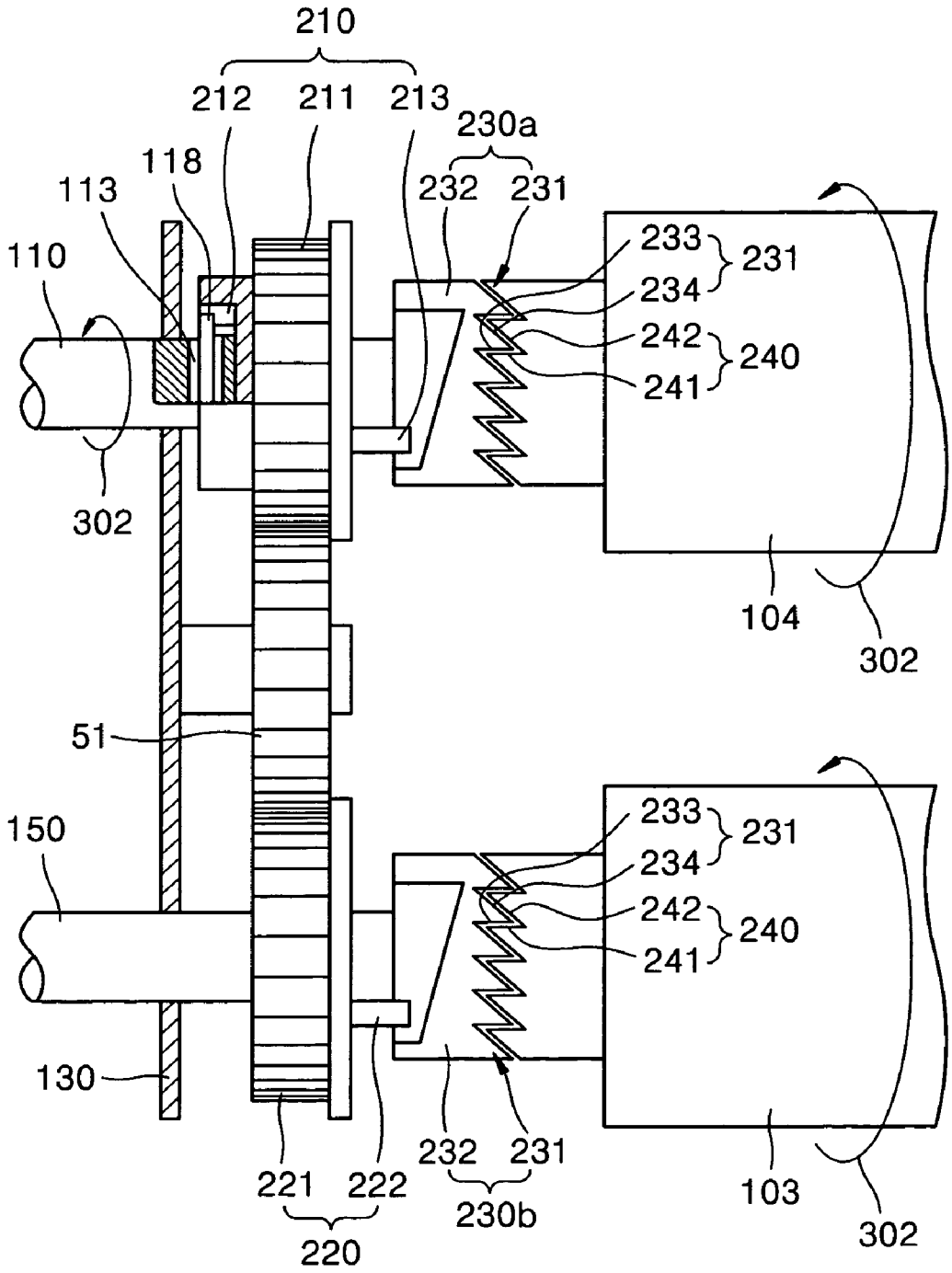
FIG. 10 is a view illustrating a relationship between a shaft, pickup roller and ADF roller in the course of removing a jammed document according to an embodiment of the present invention.

In more in detail, when the rear end of the jammed document D is pulled in the direction B to remove the jammed document D between the feed roller 106 and the reading means 107 or between the ADF roller 104 and the feed roller 106, the ADF roller 104 rotates in the second direction 302. At this point, as shown in FIG. 10, the opposing sections 241 of the second power coupling portion 240 push the opposing sections 233 of the first power coupling portion 231 in the second direction 302 and the third member 230 rotates in the second direction 302. As a result, the first member 210 and the shaft 110 also rotate in the second direction 302. Here, the operation of the clutching means 250 for selectively connecting the bracket 130 with the shaft 110 is important. When the shaft 110 rotates in the second direction 302, the bracket 130 cannot rotate in the second direction 302 by the suppressing means 160. In this case, since the first end of the clutch spring 270 is inserted in the first insertion groove 134, it is twisted in a direction where the diameter thereof reduces, thereby further biasing the first and second cylindrical projections 133 and 261. As a result, the shaft 110 and the ADF roller 104 cannot rotate in the second direction 302 as far as the bracket 130 does not rotate in the second direction 302. Since the document D is pressed between the ADF roller 104 and the separating member 105, it is difficult to remove the document D if the ADF roller 104 does not rotate. Therefore, when the document D is pulled in the direction B by excessive force, the document D may be torn.

However, in the present invention, when the shaft 110 rotates in the second direction 302, the second end of the clutch spring 270 pushes the second insertion groove 281 to rotate the clutch cover 280 in the second direction 302. At this point, since the outer circumferential projection 282 of the clutch cover 280 contacts the stopper 135, the clutch cover 280 cannot rotate. In this state, when the second end 272 of the clutch spring 270 continuously pushes the clutch cover 280 in the second direction 302, the inner diameter of the clutch spring 270 is widened. As a result, since there is a slip between the second cylindrical projection 261 and the clutch spring 270, the torque of the shaft 110 is not transmitted to the bracket 130. Accordingly, when the jammed document D is pulled in the direction B, the jammed document D can be easily removed while the ADF roller 104 and the shaft 110 smoothly rotate in the second direction 302. When the document D is jammed, the driving means 100 is disconnected with the shaft 110 by the power switching means 120. As a result, since only the ADF roller 104 and the shaft 110 rotate, the jammed document D can be more easily removed.

According to the above-described automatic document feeding apparatus, the jammed document D can be easily removed and the number of documents D fed per time can be increased.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An automatic document feeding apparatus comprising:

a shaft;

an ADF roller which feeds documents sheet by sheet by cooperating with separating means, the ADF roller being mounted on the shaft such that the ADF roller can rotate by receiving a torque only in a first direction from the shaft;

power switching means which selectively connects driving means with the shaft, the power switching means being installed on the shaft;

a pickup roller which picks up the documents stacked in a feeding base by receiving the torque only in the first direction from the shaft;

a bracket rotatably mounted on the shaft, the pickup roller being installed on the bracket;

clutching means which transmits the torque of the shaft to the bracket when the shaft rotates in the first direction and does not transmit the torque of the shaft to the bracket when the shaft rotates in a second direction; and an elastic member which biases the bracket in the second direction.

2. The automatic document feeding apparatus of claim 1, wherein the clutching means comprises:

a clutch spring fitted on a first cylindrical projection formed on the shaft and a second cylindrical projection formed on the bracket by a first fitting force to allow the bracket to rotate in the first direction, the clutch spring having a first end inserted in a first insertion groove provided on the bracket;

a clutch cover which encloses the clutch spring, the clutch cover being provided with a second groove in which a second end of the clutch spring is inserted and a circumferential projection; and a stopper contacting the circumferential projection so as to prevent the clutch spring from rotating in the second direction.

3. The automatic document feeding apparatus of claim 2, wherein the bracket is provided with a plurality of the first insertion grooves for adjusting the first fitting force.

4. The automatic document feeding apparatus of claim 2, wherein the clutch cover is provided with a plurality of the second insertion grooves for adjusting the first fitting force.

5. The automatic document feeding apparatus of claim 2, wherein the stopper is provided on the bracket.

6. The automatic document feeding apparatus of claim 1, wherein the power switching means is designed to disconnect the driving means from the shaft when the document is jammed.

* * * * *